United States Patent [19]

Kimura et al.

[11] 4,446,826

[45] May 8, 1984

[54] IGNITION SYSTEM FOR INTERNAL COMBUSTION ENGINE

[75] Inventors: Katsuhiro Kimura, Tokyo; Akira Endo; Jiro Takezaki, both of Katsuta, all of Japan

[73] Assignee: Hitachi, Ltd., Tokyo, Japan

[21] Appl. No.: 335,692

[22] Filed: Dec. 30, 1981

[30] Foreign Application Priority Data

Jan. 7, 1981 [JP] Japan ..... 56-385

[51] Int. Cl.[3] ..... F02P 23/04

[52] U.S. Cl. ..... 123/143 B; 123/286; 123/606

[58] Field of Search ..... 123/143 B, 143 R, 293, 123/286, 606

[56] References Cited

U.S. PATENT DOCUMENTS

| | | | |
|---|---|---|---|
| 2,617,841 | 11/1952 | Linder | 123/606 |
| 3,934,566 | 1/1976 | Ward | 123/606 |
| 4,003,354 | 1/1977 | Canup | 123/606 |
| 4,138,980 | 2/1979 | Ward | 123/143 B |

*Primary Examiner*—Andrew M. Dolinar

*Attorney, Agent, or Firm*—Antonelli, Terry & Wands

[57] ABSTRACT

Ignition system for internal combustion engine in which combustion chambers in an internal combustion engine are shaped in such a manner that a microwave resonance easily causes a plasma discharge, microwaves are supplied from a microwave oscillator through respective coaxial cables to all the combustion chambers so that the combustion chambers resonate whenever the microwave power is injected, or so that when the combustion chambers reaches a resonatable condition, is the microwave power injected into the combustion chambers from the microwave oscillator; thereby causing plasma discharge to occur in the combustion chambers.

4 Claims, 18 Drawing Figures

IGNITION SYSTEM FOR INTERNAL COMBUSTION ENGINE

The present invention relates to an ignition system for an internal combustion engine which fires combustible gas for combustion in a combustion chamber.

At present, it is common practice in a gasoline engine to take a mixture of gasoline and air into a combustion chamber, cause an ignition plug to bring about a high voltage spark discharge for ignition just before the top dead center of an associated piston, and push the piston downward under a pressure resulting from the combustion to thereby rotate the engine.

Such an ignition system based on high voltage spark discharge, however, has a defect that the system emits noise which has an extremely detrimental effect on the surrounding devices. Therefore, there has been long made approaches to avoid or eliminate the noise, but they all involve a considerably high cost and are still in an experimental stage. In practice, such noise from the ignition system often introduces the malfunction of electronic instruments and devices for automobile control which has been remarkably developed these days, as well as radio and television receivers. In order to avoid the noise, tests have been conducted wherein means for preventing the noise is provided for high voltage cables, distributors and ignition plugs. However, it appears difficult to achieve improvements remarkably.

On the other hand, since ignition by plugs provides only a small spark discharge region and also restricts the ignition position, it takes much time for the combustion to spread completely throughout the combustion chamber. This results in the fact that it becomes impossible to achieve an enhancement of the reduction of fuel cost and a reduction of effective exhaust gas components at the same time in the case where lean mixture is used.

Further, in the case where such fuel as having an inferior ignition characteristic to gasoline, is mixed with gasoline or is used separately without mixing, it is impossible to obtain a good combustion characteristic and a high output.

Although the high voltage discharge ignition system by plugs, as has been explained in the foregoing, has been widely employed, there are still many defects in the system and thus an appearance of a novel ignition system has been long expected in place of the plug ignition system.

In order to facilitate ignition by ignition plugs, there has been suggested in U.S. Pat. No. 3,934,566 an ignition system wherein microwaves are introduced into ignition plugs through associated coaxial cables to inject the microwaves into respective combustion chambers. However, the system is not based on a microwave resonance phenomenon.

An object of the present invention is to provide an ignition system in which microwave power is supplied to engine combustion chambers so that a microwave plasma discharge phenomenon is caused by utilizing a microwave resonance, to thereby provide a higher combustion efficiency without any noise than the high voltage discharge ignition system due to plugs of prior arts.

In an aspect, features of the present invention reside in an ignition system in which combustion chambers in an internal combustion engine are shaped in such a manner that a microwave resonance easily causes a plasma discharge, microwaves are supplied from a microwave oscillator through respective coaxial cables to all the combustion chambers so that the combustion chambers resonate whenever the microwave power is injected, or so that only when the volume of the combustion chambers reaches to a resonatable condition, the microwave power is injected into the combustion chambers from the microwave oscillator; thereby causing plasma discharge to occur in the combustion chambers.

The above and other objects, features and advantages of the present invention will be more clear from the following description with respect to the accompanying drawings, in which.

Figure 1:
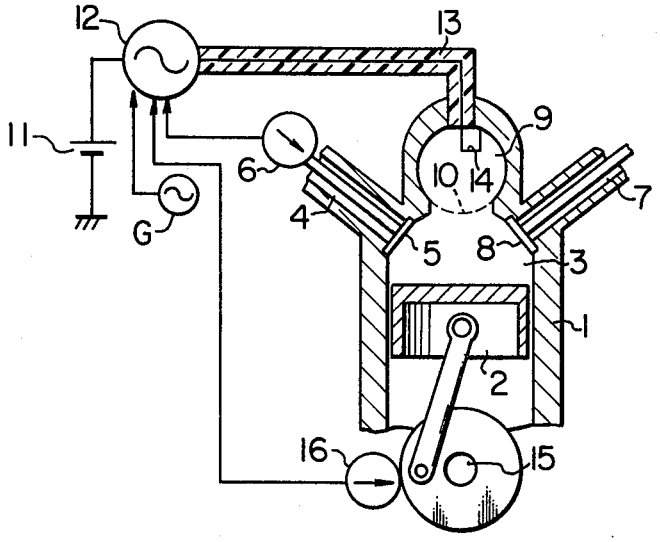
FIG. 1 is a schematic cross-sectional view of an ignition system for an engine in accordance with an embodiment of the present invention.

Referring now to FIG. 1, there is shown an ignition system, in section, for an engine according to an embodiment of the present invention which includes a combustion chamber and a microwave oscillator.

In the embodiment, a cylinder 1 and a piston 2 form a primary combustion chamber 3 which in turn is provided with an intake port 4 for mixture gas and an exhaust port 7 for discharging the fired or used gas. In the intake port 4, are provided an opening and closing valve 5 and a back or negative pressure sensor 6. An opening and closing valve 8 is disposed as substantially opposed to the valve 5.

The primary combustion chamber 3 is provided at its upper portion with a secondary combustion chamber 9 and a mesh member 10 is disposed between the two chambers. The secondary combustion chamber 9 forms a microwave resonator and a microwave power is supplied through a coaxial circuit or cable 13 from a microwave oscillator unit 12 (which in turn is driven by a power source 11) to a power supply loop 14 where the microwave power is excited. This will cause the secondary combustion chamber 9 to be put into a plasmatic state, developing a discharge phenomenon.

The mesh size of the mesh member 10 provided between the two chambers is selected so that a microwave from the oscillator unit 12 will not leak into the primary combustion chamber 3, that is, so that the mesh size is much smaller than the wave length of the microwave and will not cause the blockage of intake and discharge operations of the mixture gas. Since the secondary combustion chamber 9 forms a resonator, the resonance frequency is kept constant at any position of the piston and the frequency of the oscillator 12 can be kept to be fixed.

The microwave oscillator unit 12 operates on a pulse ON-OFF basis (which will be detailed later) and the pulse timing is determined by three output signals from an alternating current (A.C.) generator G, a negative pressure sensor 6 and a crank angle sensor 16 mounted on a crank shaft 15.

Figure 2:
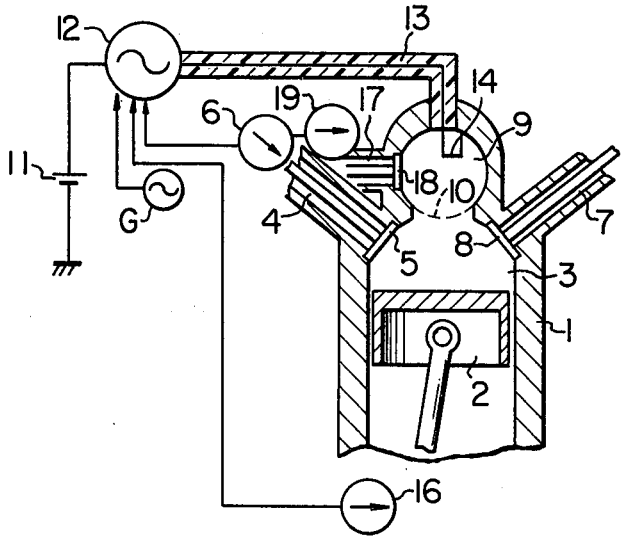
FIG. 2 is a schematic cross-sectional view of an ignition system for an engine in accordance with another embodiment of the present invention.

FIG. 2 shows another embodiment of a combustion chamber according to the present invention in which like reference numerals are applied to the same or equivalent members as those in the embodiment illustrated above. In FIG. 2, an intake port 17, an opening and closing valve 18 and a negative pressure sensor 19 are added to the secondary combustion chamber 9 in FIG. 1. The embodiment is arranged so that gas slightly different in the component and/or mixture ratio from the primary combustion chamber 3 is supplied to the secondary combustion chamber 9 so that the engine operates under good conditions, i.e., at a velocity and temperature suitable for good combustion.

The ignition conditions of embodiments shown in FIGS. 1 and 2 must be selected so that mixture in the secondary combustion chamber is put in combustion at a proper velocity and temperature, and subsequently the combustion flame expands throughout the primary combustion chamber to allow entire ignition therein. Therefore, the initial ignition conditions become very important.

Figure 3:
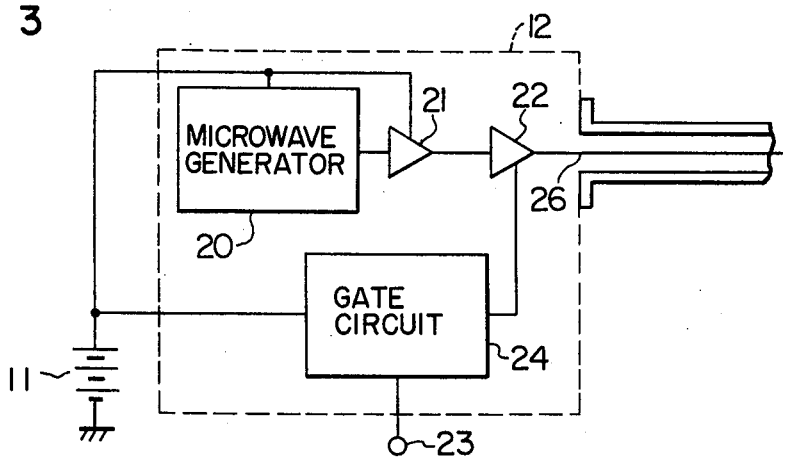
FIG. 3 is a block diagram of an oscillator circuit and a pulse drive timing circuit of a microwave generating unit used in the ignition system in accordance with the present invention.

FIG. 3 is a block diagram of an oscillator circuit and a pulse drive timing circuit in the microwave oscillator unit 12.

A microwave oscillator 20 comprises high frequency and high power transistors and a strip-line resonance circuit on a dielectric substrate. The output of the oscillator 20 is amplified by about 100 times in total by the first stage amplifier 21 and the last stage amplifier 22.

Only when a signal is applied to a timing signal terminal 23, a gate circuit 24 is closed to activate the last stage amplifier 22 and the amplified microwave power is supplied via a coaxial circuit or cable 26 to the secondary combustion chamber. In the case of a multi-cylinder engine, for example, the last-stage amplifier 22 and coaxial cable 26 are provided respectively by the number of engine cylinders and the respective last-stage amplifiers 22 are activated by corresponding signals distributed by the gate circuit 24.

The ignition timing varies depending upon the rotational speed and load condition for the engine but is selected usually to be 5 to 10 degrees before the top dead point of the piston.

Figure 4:
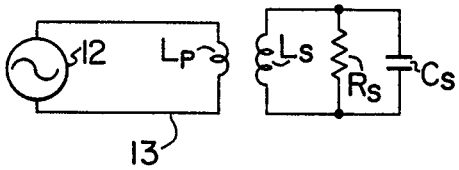
FIG. 4 is an equivalent circuit of the ignition system of the present invention.

Turning next to FIG. 4, there is shown an equivalent circuit of the secondary combustion chambers shown in FIG. 1 or 2, where $L_P$ is an inductance of the secondary combustion chamber, $R_S$ is an impedance of the secondary combustion chamber, and $C_S$ is a capacitance of the secondary combustion chamber. A resonance frequency $f_o$ of the secondary is expressed as follows.

$$f_o = \frac{1}{2\pi\sqrt{L_S \cdot C_S}}$$

In the embodiments of FIGS. 1 and 2, each secondary combustion chamber has been shaped into a sphere, but it will be easily understood that other resonator shapes may be employed to obtain the similar operation.

Further, the mesh member provided between the primary and secondary combustion chambers can be eliminated by making small the diameter of a communication opening between the two chambers to such a degree to allow a blockage of the microwave not to leak into the primary chamber.

Figure 6:
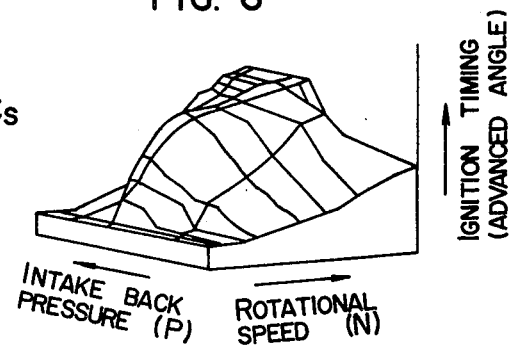
FIG. 6 is a data map showing the relationship among the engine rotational speed, the intake back pressure and the ignition timing.
Figure 5:
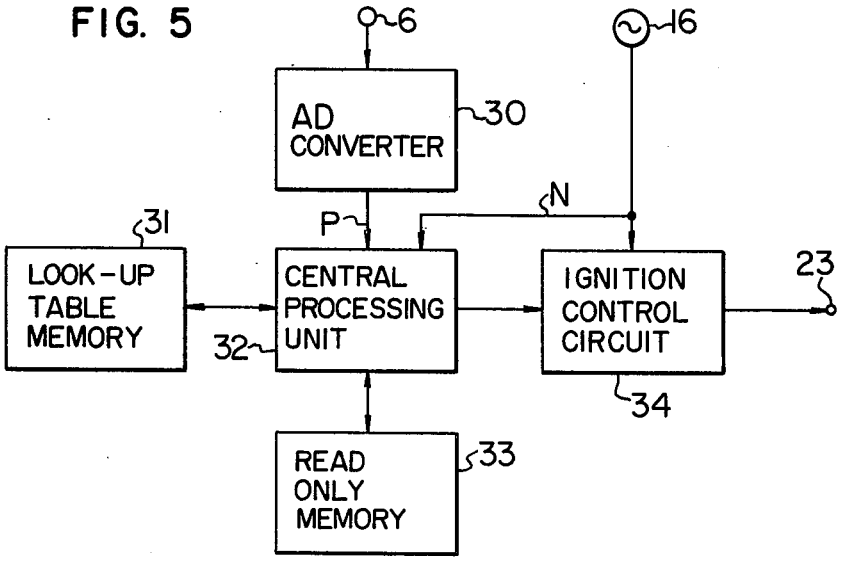
FIG. 5 is a block diagram of a circuit which generates an ignition timing signal.

FIG. 5 shows a circuit used to generate a ignition timing signal from two output signals of the crank angle sensor 16 and negative pressure sensor 6. In general, complex control is required over existing engines in order to improve the fuel cost and satisfy related exhaust emission regulations. For this purpose, a conventional distributor has been so far used. Recently, an ignition timing control by a governor mechanism (which utilizes a bellows negative pressure sensor and a centrifugal force) is being replaced by a microcomputer control. An example of a microcomputer control is shown in FIG. 5 in which an analog signal from the negative pressure sensor 6 is converted into a digital signal P by an AD convertor 30, the digitalized signal P is supplied to a central processing unit 32 together with a signal N sent from the crank angle sensor 16 so that the then optimum ignition timing is found from a look-up table memory 31 wherein a data map as shown in FIG. 6 (indicating the relationship between the rotational speed N and the intake negative pressure P) is stored and the found valves N and P are used to control an ignition control circuit 34 and thereby generate a timing pulse signal 23. In the embodiments as has been described above, the microwave oscillator unit 12 is driven according to this timing pulse signal 23.

It will be also appreciated that a way to get such an ignition timing signal is not restricted to FIG. 5 and instead, a well known ignition timing device for engine control may be applied to the present invention.

Figure 7:
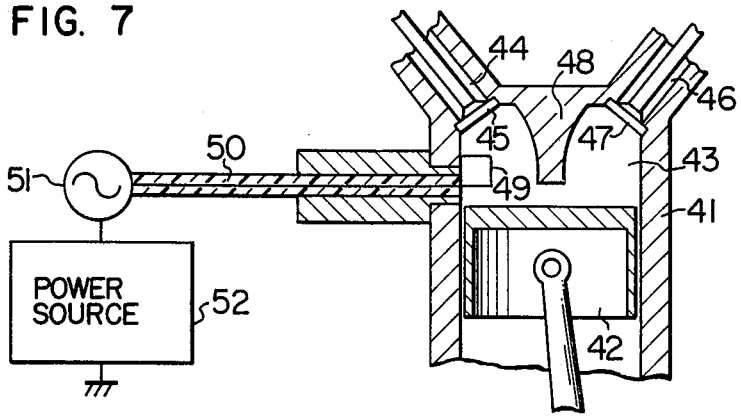
FIG. 7 is a schematic cross-sectional view of an ignition system for an engine in accordance with yet another embodiment of the present invention.

FIG. 7 shows an engine combustion chamber, in cross section, as yet another embodiment of the present invention. In the figure, a cylinder 41 and a piston 42 constitute a sectionally U-shaped combustion chamber 43 as shown. The chamber 43 is provided at its upper wall with a mixture gas intake port 44 and an exhaust port 46. In the ports 44 and 46, opening and closing valves 45 and 47 are disposed as opposed to each other, respectively. The chamber 43 is also formed at the upper and central wall with a conical projection 48 which extends up to the close proximity of a head position corresponding to the top dead center of the piston 2. A microwave power is supplied from an external microwave oscillator 51 via a coaxial cable 50 to a power supply loop 49 which in turn is mounted on the inner wall of the chamber 43.

The microwave oscillator unit 51 is a high frequency transistor oscillator of combined parallel output type or magnetron which is connected to a power source 52 and generates 1 KW output power.

In the operation of the combustion chamber referred to above, a mixture gas is introduced through the intake port 44 into the combustion chamber 43. As the piston 42 is moved upward, the engine is put into the compression stroke. The mixture in the combustion chamber 43 is compressed and as soon as the piston arrives at a position immediately before the top dead center (corresponding to 5 to 10 degrees in advanced angle), the chamber 43 is subject to a cavity resonance phenomenon at a resonance frequency of the microwave oscillator unit 51.

Simultaneously with the resonance, the microwave power is sent into the chamber 43 so that a microwave plasma discharge phenomenon takes place therein.

The plasma discharge phenomenon will cause gaseous molecules to vibrate strongly and collide with each other, developing ionization thereof. The ionized electrons repeatedly further collide with other molecules and neutral atoms. In this way, electrons occurred in the high frequency electric field are increased in numbers. This results in the fact that the charged particles are captured within the space as the electric field is reversed. As slow ions are first captured, the space charge will retard or delay the diffusion action of electrons such that a stationary or steady discharge is maintained. Such a phenomenon, in general, takes place under a reduced pressure. In the embodiments according to the present invention, however, a high power causes a substantially plasma discharge to occur under a mixture gas pressure of 8 to 9 atmosphers and thereby achieve combustion of the mixture gas.

Figure 8:
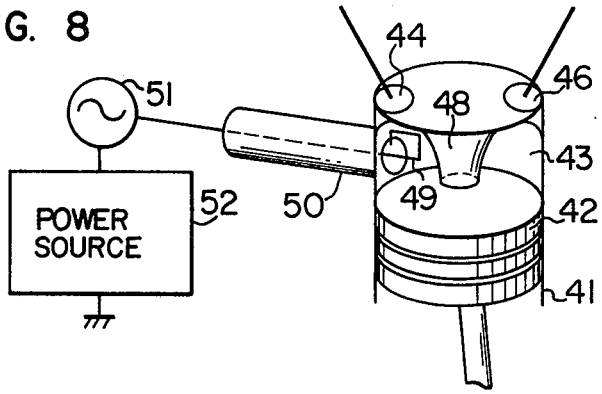
FIG. 8 is a schematic perspective view of the embodiment shown in FIG. 7.

It will be best seen from FIG. 8 that the projection 48 is of a conical cross section.

Figure 9:
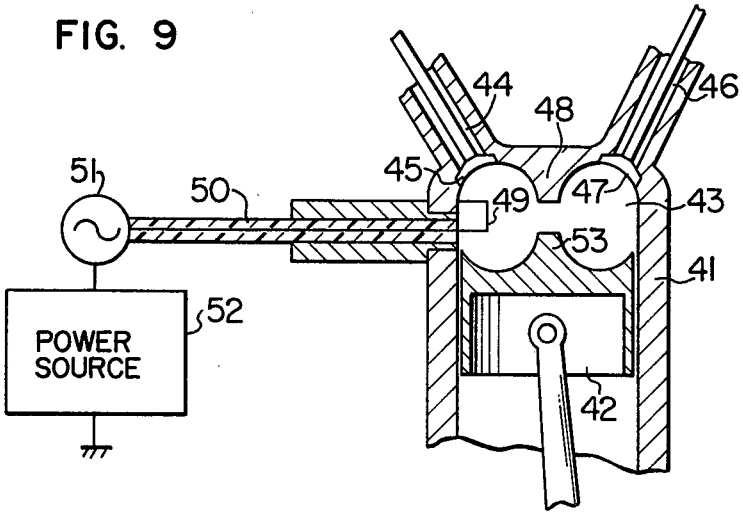
FIGS. 9 and 10 are schematic cross-sectional views of ignition systems for an engine in accordance with still another different embodiments of the present invention.
Figure 10:
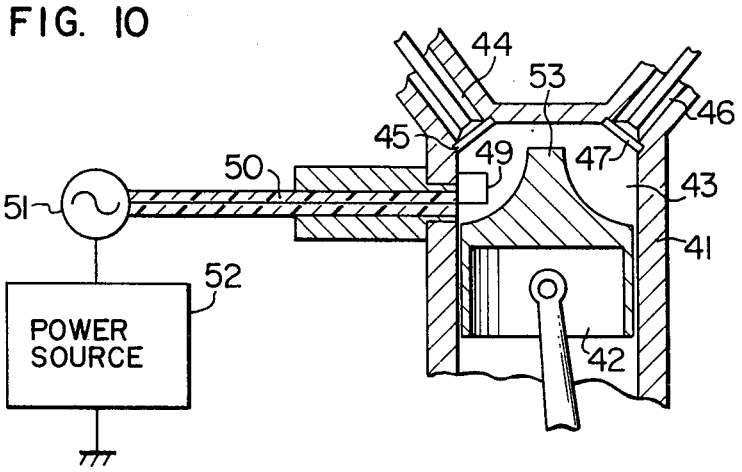

FIGS. 9 and 10 show different versions of the substantially sectionally U-shaped combustion chamber shown in FIG. 7.

In FIG. 9, the combustion chamber is provided at the top and bottom walls with the projection 48 and a projection 53, respectively. The both projections are spaced so that the spacing between the projections becomes several millimeters when the piston 42 reaches its top dead center. Although the spacing has been made somewhat variable in our experiments, it can not be made variable one-sidedly since the combustion chamber changes in its resonance frequency. The similar results can also be obtained when the configuration of the projection 53 on the piston head in further modified as shown in FIG. 10.

The combustion chambers and coaxial cable circuits in FIGS. 7 to 10 have the same equivalent circuit as shown in FIG. 4.

As the resonance frequency of the combustion chamber, about 3 $GH_Z$ is used in the embodiments.

Figure 11:
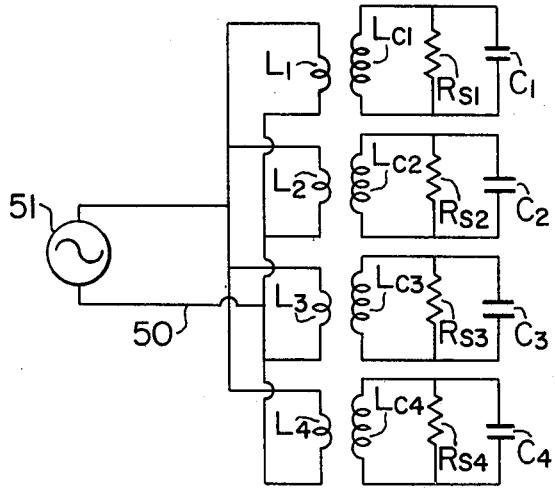
FIG. 11 is an equivalent circuit of combustion chambers used in a four-cylinder engine.

The equivalent circuit of FIG. 4 corresponds to a single combustion chamber, and thus in the case of a four cylinder engine, its whole equivalent circuit is as shown in FIG. 11. In FIG. 11, the four combustion chambers are each connected in parallel with the microwave oscillator unit 51 with use of the coaxial cables 50. The embodiment of FIG. 11 is designed so that when the combustion chambers become resonant with the oscillation frequency of the microwave oscillator unit 51, the microwave power is supplied to the resonated chamber. This enables the coaxial cables to be connected to the chambers at all times and such a distributor as to switch the combustion chambers to be eliminated.

Figure 12:
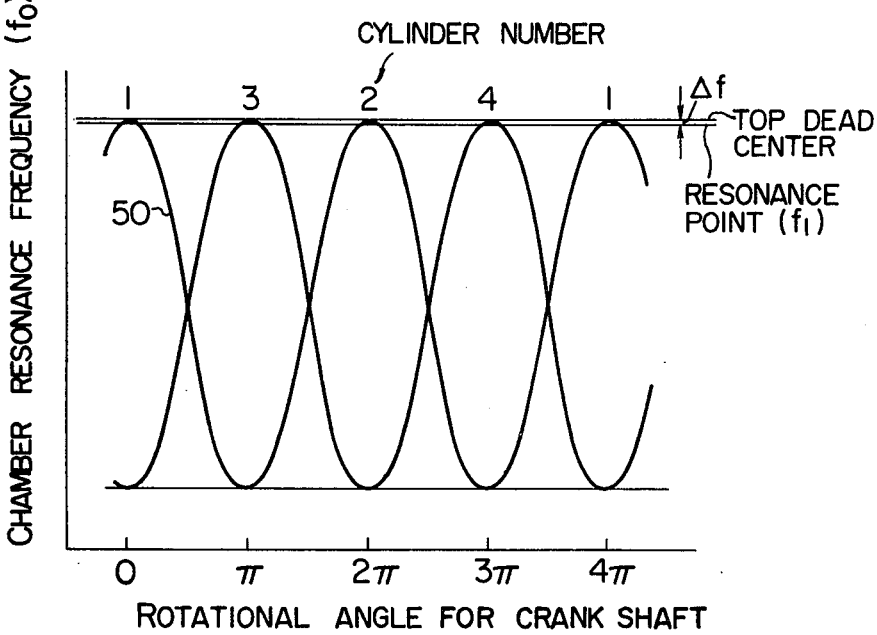
FIG. 12 is a graph showing the relationship between the rotational angle of engine crank shaft and the resonance frequency of the combustion chamber.

FIG. 12 is a graph showing the relationship of the resonance frequency of the combustion chamber to the rotational angle of the crank shaft. The resonance frequency $f_o$ is varied with the upward and downward movement of the piston and becomes at its maximum when the piston moves upward to the top dead center and at its minimum when it moves downward to the bottom dead center. The combustion chambers each arrives twice at its top dead center while the crank shaft rotates by two turns. However, one of said two arrivals is used to draw off or exhaust the burned or used gas, in which case even if a microwave power is sent to the combustion chamber in question, combustion will not occur, since there is no combustion gas therein.

The oscillation frequency of the microwave oscillator unit 51 must be set at a frequency $\Delta f$ slightly lower than the resonance frequency at the top dead center.

The resonance frequency of a combustion chamber is somewhat different even at the same top dead center position, depending on its operational mode including conditions when the chamber takes in the gas mixture, after the combustion stroke and after the exhaust stroke. For this reason, the resonance frequency $f_1$ just before the top dead center following the intake and compression strokes is selected to be the oscillation frequency of the microwave oscillator unit 51.

Figure 13:
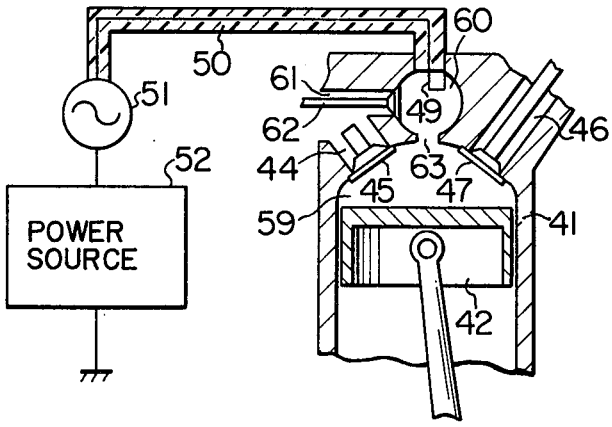
FIG. 13 is a schematic cross-sectional view of an ignition system for an engine in which a combustion chamber is divided into a primary combustion chamber and a secondary combustion chamber in accordance with the present invention.

FIG. 13 shows an exemplary combustion chamber consisting of two parts, unlike the single combustion chamber described above, that is, a primary combustion chamber 59 and a secondary combustion chamber 60. The secondary chamber is provided with a mixture gas intake port 61 in which an opening and closing valve 62 is disposed. The secondary combustion chamber 60 is communicated via a communication opening 63 with the primary combustion chamber 59. In this case, a microwave plasma discharge must be set to occur at a resonance frequency common to the both chambers, and the secondary and primary chambers 60 and 59 will function as a primary and a secondary resonator, respectively (that is, as the two resonators coupled to each other).

In the secondary combustion chamber 60, the high frequency electric field can be relatively easily concentrated so that the initially occurred plasma discharge fires or ignites the mixture in the secondary chamber and extends toward the primary chamber 59, whereby the whole mixture in the both chamber can be burned completely.

Figure 14:
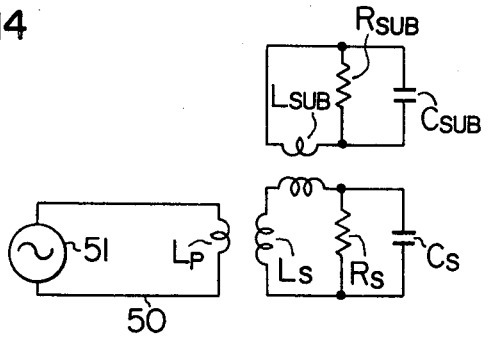
FIG. 14 is an equivalent circuit of the primary and secondary combustion chambers shown in FIG. 13.

FIG. 14 is an equivalent circuit of the combustion chamber and coaxial cable circuit shown in FIG. 13; in which an inductance $L_{SUB}$, capacitance $C_{SUB}$ and impedance $L_{SUB}$ equivalent to the secondary combustion chamber are added to the resonance circuit of FIG. 4, as shown. In the embodiment illustrated, the resonance circuit of the secondary chamber forms a parallel resonance circuit with that of the primary chamber.

In this way, even though mixture gas in the two chambers are constant or variable in the thickness or concentration, the optimum valve can be selected so as to allow the optimum combustion under various conditions.

Although the above explanation has been made in connection with the secondary combustion chamber 60 having a spheral configuration in this embodiment, it will be appreciated that other configurations may be employed for the chamber 60 so as to achieve the same purpose.

Figure 15:
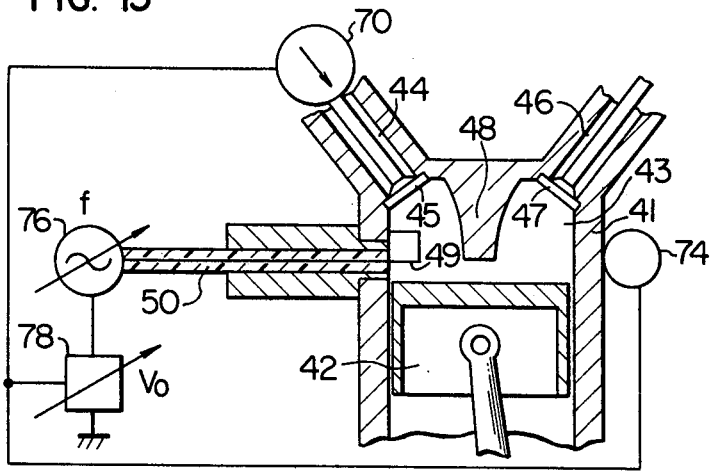
FIG. 15 is a schematic cross-sectional view of an engine ignition system in accordance with still another embodiment of the present invention, wherein the oscillation frequency of microwaves is changed according to the rotational condition of the engine.

Turning now to FIG. 15, there is shown still another embodiment of the present invention in the case where the timing of combustion ignition is changed according to the rotational condition of the engine. The combustion ignition timing must be changed depending upon the rotational speed, load condition, etc. and as well as the concentration of mixture gas, be set always at an optimum.

In order to compensate for variations in the resonance frequency of the combustion chamber resulting from a varying ignition frequency of the microwave oscillator unit, in this embodiment, the oscillation frequency of the oscillator unit can be properly controlled by adjusting the operating voltage of the oscillator unit or adjusting circuit constant of elements in the resonance circuit of the unit. More specifically, the ignition timing can be adjusted by detecting the amount of intake air introduced into the chamber 43 by means of a flow meter 70, sending as a feedback analog signal a shift in the ignition timing accompanied by the detected amount to a variable frequency microwave oscillator unit 76 and controlling the frequency of the unit 76. In order to compensate for variations in the resonance frequency of the combustion, on the other hand, the oscillation frequency of the microwave oscillator unit 76 can be adjusted by controlling the voltage of a variable voltage source 78. Further, in order to compensate for variations in the resonance frequency of the combustion chamber, the oscillation frequency of the microwave oscillator unit 76 can be adjusted by controlling the voltage of the variable voltage source 78 according to the combustion condition detected by a knocking sensor 74 (which serves to detect knocking phenomenon).

Figure 16:
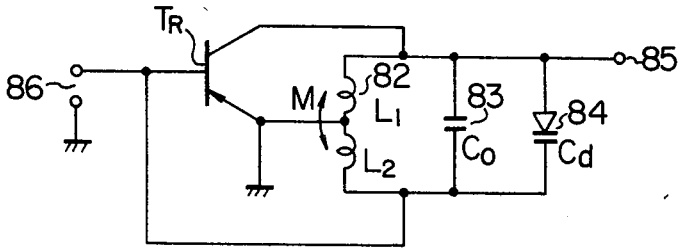
FIG. 16 is a circuit diagram of a voltage-controlled transistor oscillator applicable in the present invention.

FIG. 16 shows an exemplary circuit of a transistor oscillator unit fo voltage controlled type which is applicable in the embodiment of FIG. 15. wherein a parallel resonance circuit is provided between the emitter and collector of a high frequency transistor $T_R$m and comprises an inductance 82, a capacitance 83 and varactor diode 84.

The oscillation conditions of the resonance circuit are:

$$\frac{L_2 + M}{L_1 + M} \leq \frac{y_{fe}}{y_{oe}}$$

Thus, the oscillation frequency is written as follows.

$$f \simeq \frac{1}{2\pi\sqrt{C(L_1 + L_2 + 2M)}}$$

where, M is a mutual inductance between $L_1$ and $L_2$, $y_{fe}$ and $y_{oe}$ are transistor's parameters y and C is equal to $C_o + C_d$.

Figure 17:
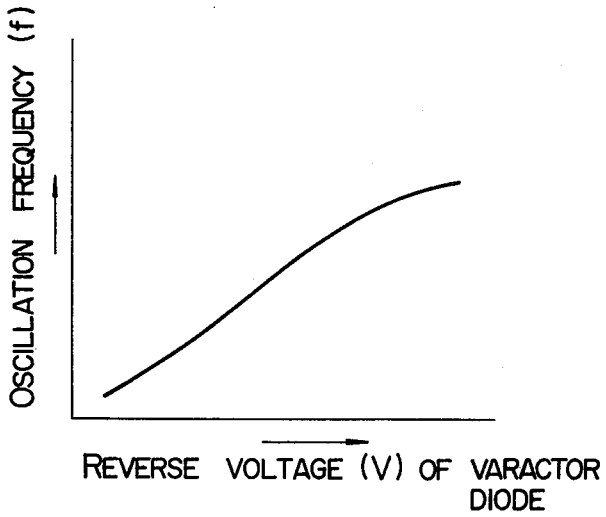
FIG. 17 is a graph showing the relationship of the oscillation frequency to the reverse voltage of a varactor diode used in the circuit of FIG. 16.
Figure 18:
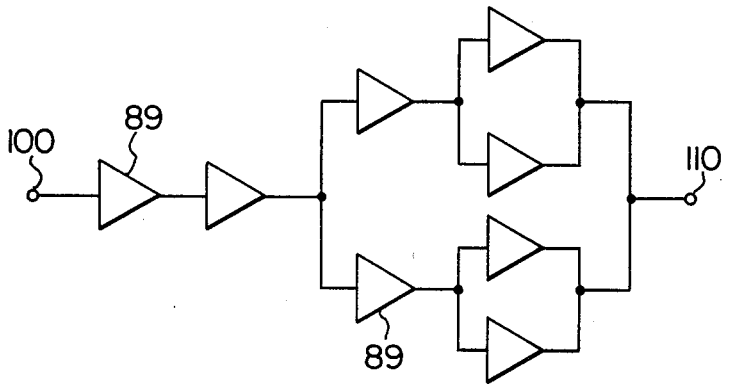
FIG. 18 is a block diagram of a high frequency amplifier applicable in the embodiment of FIG. 16.

The capacitance of the varactor diode 84 can be varied by changing the bias voltage from an external voltage terminal 85. The transistor $T_R$ produces its output at its base terminal 86 to supply it to a suitable high frequency amplifier circuit. The relationship of the oscillation frequency f to the reverse voltage v of the varactor diode is shown in FIG. 17. In this connection, the oscillation frequency is changed in response to the ignition timing resulting from the engine rotational speed N and the intake negative pressure P. The oscillation output of the transistor $T_R$ is of several watts and desirably amplified by a high frequency amplifier circuit as shown in FIG. 18, in which eight high frequency transistor amplifiers 89 are connected is series-parallel combinations as shown in the figure. The amplifier circuit of FIG. 18 has a power gain ratio of output to input of 2000.

More specifically, a signal applied from an input terminal 100 is amplified by two series-connected amplifiers, a parallel circuit of two amplifiers and then two parallel circuits of each two parallel-connected transistor amplifiers. If the input power is 50 mW, then the amplifier circuit of FIG. 18 produces an output of 100 W at an output terminal 110, since the amplifier circuit has an output/input power gain ratio of 2000.

In order to obtain a higher output, two or three of the transistor amplifier circuit of FIG. 18 may be used. In this connection, since transistors in the amplifier circuits are contained in the form of an integrated circuit in a casing which in turn is provided with a large heat radiation fins, the casing can be made compact.

While the present invention has been explained with reference to the preferred embodiments shown in the drawings, it should be understood that the invention is not limited to those embodiments but covers all other possible modifications, alternatives, and equivalent arrangements included in the scope of the appended claims.

What is claimed is:

1. An ignition system for an internal combustion engine comprising a cylinder for said engine, a piston which reciprocates within said cylinder, a combustion chamber defined by the cylinder and said piston, a power supply loop provided on a part of said combustion chamber, a microwave generator circuit for generating a microwave as ignition energy, and a coaxial cable through which the microwave is supplied from said microwave generator circuit to said power supply loop, wherein a microwave applied to the power supply loop will cause the combustion chamber to be put in the resonance state and generate a plasma discharge, whereby combustible gas introduced in the combustion chamber can be ignited; wherein said combustion chamber is divided into a primary combustion chamber and a secondary combustion chamber, and said secondary chamber functions as a cavity resonator; and wherein a filter is provided in an opening between said primary and secondary combustion chambers, said filter allowing no passage of the microwaves and passage of the combustible gas.

2. An ignition system as set forth in claim 1 wherein when the volume of said combustion chamber is put in the cavity resonance condition at a microwave resonance frequency, the microwave is injected into the chamber via said power supply loop.

3. An ignition system as set forth in claim 1 wherein the microwave from said microwave generator circuit is supplied to said power supply loop in an ignition timing that in turn is determined by the relationship between a rotational speed and an intake back pressure for said engine.

4. An ignition system as set forth in claim 1, wherein a first intake port for a mixture of fuel and air communicates with said primary combustion chamber by way of a first opening and closing valve, and a second intake port for a mixture of fuel and air communicates with said secondary combustion chamber by way of a second opening and closing valve.

* * * * *